US006446594B2

(12) United States Patent
Watanabe et al.

(10) Patent No.: US 6,446,594 B2
(45) Date of Patent: Sep. 10, 2002

(54) COMPONENT MOUNTING ARRANGEMENT FOR ENGINE

(75) Inventors: Hitoshi Watanabe; Akihiro Onoue, both of Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/742,777

(22) Filed: Dec. 20, 2000

(30) Foreign Application Priority Data

Dec. 20, 1999 (JP) ..... 11-361612

(51) Int. Cl.[7] ..... F02M 33/02
(52) U.S. Cl. ..... 123/198 E
(58) Field of Search ..... 123/198 E, 518, 123/184.21, 143 C, 195 E, 195 A, 195 C, 195 P

(56) References Cited

U.S. PATENT DOCUMENTS 5,203,292 A 4/1993 Motose
5,353,758 A 10/1994 Masuda et al.
5,899,197 A * 5/1999 Watanabe et al. ..... 123/184.42
5,983,878 A * 11/1999 Nonaka et al. ..... 123/687

* cited by examiner

*Primary Examiner*—Gene Mancene
*Assistant Examiner*—Hyder Ali
(74) *Attorney, Agent, or Firm*—Knobbe, Martens, Olson & Bear, LLP

(57) ABSTRACT

A component mounting arrangement for an engine includes an improved construction that can allow components such as a wire harness and/or fluid conduits to be neatly arranged around the engine. The engine includes a valve actuation mechanism and a drive mechanism through which a crankshaft drives the valve actuation mechanism. The drive mechanism is disposed generally above a cylinder block and a cylinder head assembly. At least one guide member is arranged to guide the wire harness and/or the fluid conduit across the engine. The guide member traverses above the drive mechanism.

33 Claims, 11 Drawing Sheets

COMPONENT MOUNTING ARRANGEMENT FOR ENGINE

PRIORITY INFORMATION

This invention is based on and claims priority to Japanese Patent Application No. Hei 11-361612, filed Dec. 20, 1999, the entire contents of which is hereby expressly incorporated by reference.

BACKGROUND OF THE INVENTION

1. Field of the Invention

This invention relates to a component mounting arrangement for an engine, and more particularly to an improved mounting arrangement of wire harness and/or one or more fluid conduits for an engine.

2. Description of Related Art

As will be expected, space within any engine compartment generally is at a premium and the wire harness occupies a certain amount of this space.

In addition, the engine normally has external fluid conduits that supply fuel, water and/or oil to appropriate locations of the engine. The external conduits are used because internal fluid passages can be difficult to form. In addition, the space within the block of the engine is often tightly arranged such that passages of adequate size generally cannot be formed within the engine.

In all fields of engine design, there is increasing emphasis on obtaining high performance in output and more effective emission control. This trend has resulted in employing, for example, a multi-cylinder, fuel injected, four-cycle engine. The engine can have multiple cylinders, such as six cylinders arranged in V-configuration.

The engines often require a number of electrical wires for collecting sensor signals to a control device from any of a number of sensors and for sending control signals to actuators from the control device. These wires often are gathered in a bundle referred to as a wire harness. The wire harness for these sensors and actuators is thus likely to be voluminous and makes it difficult to adequately place individual wires around the engine.

The engines often also use external fluid passing conduits. For instance, fuel can be delivered through fuel supply lines formed external to the engine. Of course, other fluids, such as oil and coolant, also are supplied to the engine through external conduits. Thus, it is a serious problem with the engine how the wire harness and fluid conduits are neatly arranged around the engine.

A marine drive such as an outboard motor can of course employ this type of engine. The mounting configuration problem, however, is substantially more serious with an engine for a typical outboard motor because the engine is surrounded by a protective cowling. The protective cowling often is tightly arranged relative to the engine to reduce the overall girth of the outboard motor. Accordingly, the protective cowling generally contains a very limited space in which the wire harness and fluid conduits can be arranged around the engine.

A need therefore exists for an improved component mounting arrangement for an engine that can neatly arrange wire harness or at least one fluid conduit around the engine.

Also, a typical four-cycle engine includes one or more intake and exhaust valves for opening anti closing intake and exhaust ports, respectively, so as to introduce air into the combustion chambers and to discharge exhaust gases from the combustion chambers. A valve cam mechanism that includes intake and exhaust camshafts is provided for actuating the valves. A drive mechanism drives the valve cam mechanism. Typically, the drive mechanism includes a crankshaft and an endless transmitter such as a chain or belt. The crankshaft has a drive sprocket, while the intake and exhaust camshafts have driven sprockets. The endless transmitter is wound around the drive and driven sprockets so that the crankshaft drives the respective camshafts through the endless transmitter.

The typical four-cycle engine for the outboard motor has a crankshaft and camshafts all extending generally vertically. The drive mechanism including the endless transmitter thus is normally located on a top surface of the engine. If the foregoing wire harness and conduits extend over the drive mechanism, the endless transmitter may damage the wire harness or conduits due to inadvertent contact during operation. If, on the other hand, the wire harness and conduits extend below the drive mechanism, the crankshaft and camshafts must be extended an extra length from the top surface of the engine and a relatively large bending moment can exert upon these shafts during operation. The shafts and bearing construction therefore would have to be strengthened.

There can be another arrangement in which the wires and conduits extend on side surfaces of the engine. This arrangement, however, requires relatively long lengths of the wire harness and conduits. Long wires can generate electrical noise in the electrical system and the electrical noise can disrupt operations of the electrical system. Additionally, long conduits can delay delivery of the fluids routed through the conduits. Further, a production cost of the wires and conduits in this arrangement becomes high apparently.

Another need therefore exists for an improved component mounting arrangement that can arrange wire harness and/or one or more fluid conduits on a top surface of an engine where a drive mechanism is provided without damaging wires and/or conduits by a endless transmitter or without requiring to strengthen the crankshaft, camshafts and/or bearing constructions.

SUMMARY OF THE INVENTION

In accordance with one aspect of the present invention, an internal combustion engine comprises a cylinder block defining at least one cylinder bore extending generally horizontally. A piston reciprocates within the cylinder bore. A cylinder head assembly closes an end of the cylinder bore to define, together with the cylinder bore and the piston, a combustion chamber. A crankshaft extends generally vertically and coupled with the piston so as to rotate with the reciprocal movement of the piston. An air induction system is arranged to introduce air to the combustion chamber. The cylinder head assembly defines an intake port through which the air is drawn to the combustion chamber. A valve is arranged to selectively open and close the intake port. A valve actuation mechanism is disposed generally opposite to the crankshaft relative to the piston. A drive mechanism is provided through which the crankshaft drives the valve actuation mechanism. The drive mechanism is disposed generally above the cylinder block and the cylinder head assembly. At least one guide member is arranged to guide at least one wire, wire harness or fluid conduit of the engine across and above the drive mechanism.

In accordance with another aspect of the present invention, an internal combustion engine comprises an engine body defining at least one combustion chamber. An air intake passage introduces air to the combustion chamber. A valve is arranged to block the air to be drawn into the combustion chamber when placed in a closed position. A valve actuation mechanism is arranged to actuate the valve from the closed position. The valve actuation mechanism includes a drive unit, an actuation unit actuating the valve, and a transmitter arranged to transmit the driving force of the drive unit to the actuation unit. The transmitter is spaced apart from the engine body by a first distance. At least one groove member is arranged to support a wire harness or a fluid conduit of the engine. The groove member is spaced apart from the engine body by a second distance which is different from the first distance.

In accordance with a further aspect of the present invention, an internal combustion engine comprises a cylinder block defining at least two cylinder bores extending generally horizontally. The cylinder bores are spaced apart from each other so as to form V-configured banks. Pistons reciprocate within the cylinder bores. A pair of cylinder head assemblies closes each end of the cylinder bores to define, together with the cylinder bores and the pistons, combustion chambers. At least the cylinder block and the cylinder head assembly together define an engine body. At least two fuel injectors are provided and each fuel injector is arranged to supply fuel at least one of the combustion chambers. The respective fuel injectors are spaced apart relative to each other. A fuel conduit communicates with the respective fuel injectors. At least one guide member is arranged to guide the fuel conduit. The guide member extends transversely over the engine body.

Further aspects, features and advantages of this invention will become apparent from the detailed description of the preferred embodiment which follows.

BRIEF DESCRIPTION OF THE DRAWINGS

These and other features, aspects and advantages of the present invention will now be described with reference to the drawings of a couple of preferred embodiments which are intended to illustrate and not to limit the invention. The drawings comprise eleven figures.

FIG. 11(A) is a top plan view of the guide member, FIG. 11(B) is a side view thereof, FIG. 11(C) is a rear view thereof and FIG. 11(D) is a front view thereof.

DETAILED DESCRIPTION OF THE PREFERRED EMBODIMENTS OF THE INVENTION

Figure 1:
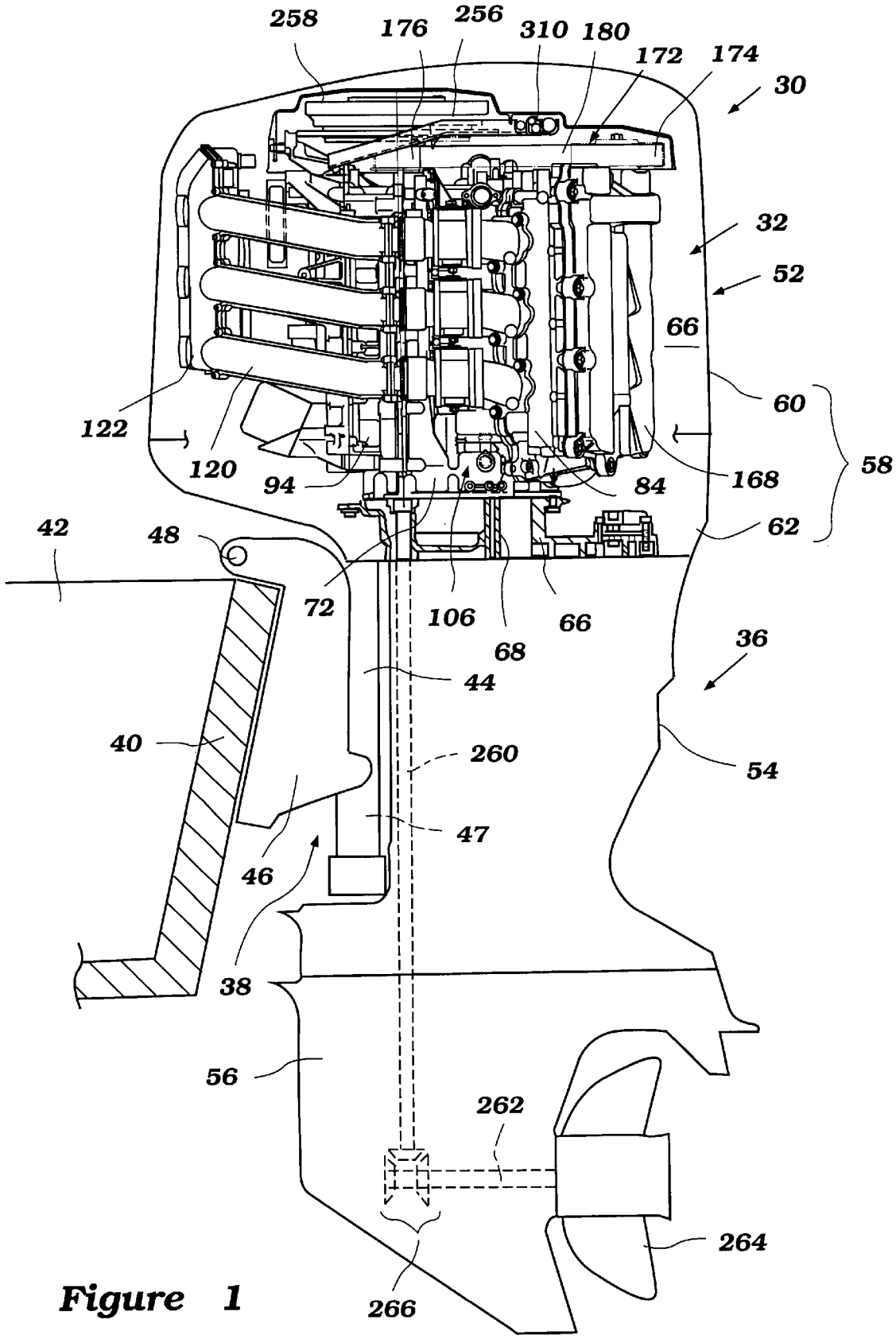
FIG. 1 is a side elevational view of an outboard motor employing an engine arranged in accordance with a preferred embodiment of the present invention. A power head of the outboard motor is schematically illustrated to show the engine thereof. Part of an associated watercraft, on which the outboard motor is mounted, is additionally illustrated in section. A vapor separator is omitted in this figure.

With primary reference to FIG. 1–7 and additionally to FIG. 8, an overall construction of an outboard motor 30, which includes an engine 32 arranged in accordance with certain features, aspects and advantages of the present invention, will be described. Although the present invention is shown in the context of an engine for an outboard motor, various aspects and features of the present invention also can be applied to engines used in other types of marine drives (e.g., stem drives and in-board motor/out-board drives), to other engines used in land vehicles and to stationary engines.

In the illustrated embodiment, the outboard motor 30 comprises a drive unit 36 and a bracket assembly 38. The bracket assembly 38 supports the drive unit 36 on a transom 40 of an associated watercraft 42 so as to place a marine propulsion device in a submerged position with the watercraft 42 resting on the surface of a body of water. The bracket assembly 38 comprises a swivel bracket 44, a clamping bracket 46, a steering shaft 47 and a pivot pin 48.

The steering shaft 47 typically extends through the swivel bracket 44 and is affixed to the drive unit 36. The steering shaft is pivotally journaled for steering movement about a generally vertically extending steering axis within the swivel bracket 44. The clamping bracket 46 includes a pair of bracket arms spaced apart from each other and affixed to the transom 40 of the associated watercraft 42. The pivot pin 48 completes a hinge coupling between the swivel bracket 44 and the clamping bracket 46. The pivot pin 48 extends through the bracket arms so that the clamping bracket 46 supports the swivel bracket 46 for pivotal movement about a generally horizontally extending tilt axis of the pivot pin 48.

A hydraulic tilt and trim adjustment system preferably is provided between the swivel bracket 44 and the clamping bracket 46 so as to raise or lower the swivel bracket 44 and the drive unit 36 relative to the clamping bracket 38. A tilt movement of the swivel bracket 44 and the drive unit 36 in a small angle range preferably gives a trim adjustment of the outboard motor 30. That is, the trim adjustment movement of the drive unit 36 trims a position of the watercraft 42. A movement in a range larger than the trim range gives the drive unit 36 positions in which generally the entire drive unit 36 is out of the water for maintenance or to reduce the likelihood of corrosion by water, for example.

As used through this description, the terms "fore," "front," forward" and "forwardly" mean at or to the side where the clamping bracket 46 is located, and the terms "aft," "rear," "reverse" and "rearwardly" mean at or to the opposite side of the front side, unless indicated otherwise or otherwise readily apparent from the context of use.

The drive unit 36 includes a power head 52, a driveshaft housing 54 and a lower unit 56. The power head 52 is disposed atop the drive unit 36 and includes the engine 32 and a protective cowling assembly 58. The protective cowling assembly 58 includes a top cowling member 60 and a bottom cowling member 62.

The protective cowling assembly 58 defines a generally closed cavity 66 in which the engine 32 is enclosed. The top cowling member 60 is detachably affixed to the bottom cowling member 62 so that a user, operator, mechanic or repairperson can access the engine 32 for maintenance or for other purposes. The top cowling member 60 has at least one air intake opening preferably disposed on its rear and top portion. Ambient air enters the closed cavity 66 through the opening. Typically, the top cowling member 60 is narrowed upwardly. The cavity 66 has a capacity that is sufficient for enclosing the engine 32 and components which are related to the engine operation.

The bottom cowling member 62 has an opening at its bottom portion through which an upper portion of an exhaust guide member 66 extends. The exhaust guide member 66 is affixed atop the driveshaft housing 54. The bottom cowling member 62 and the exhaust guide member 66 together generally form a tray. The engine 32 is placed onto this tray and is affixed to the exhaust guide member 66. The exhaust guide member 66 also has an exhaust passage 68 through which burnt charges (e.g., exhaust gases) from the engine 32 are discharged as described below.

Figure 4:
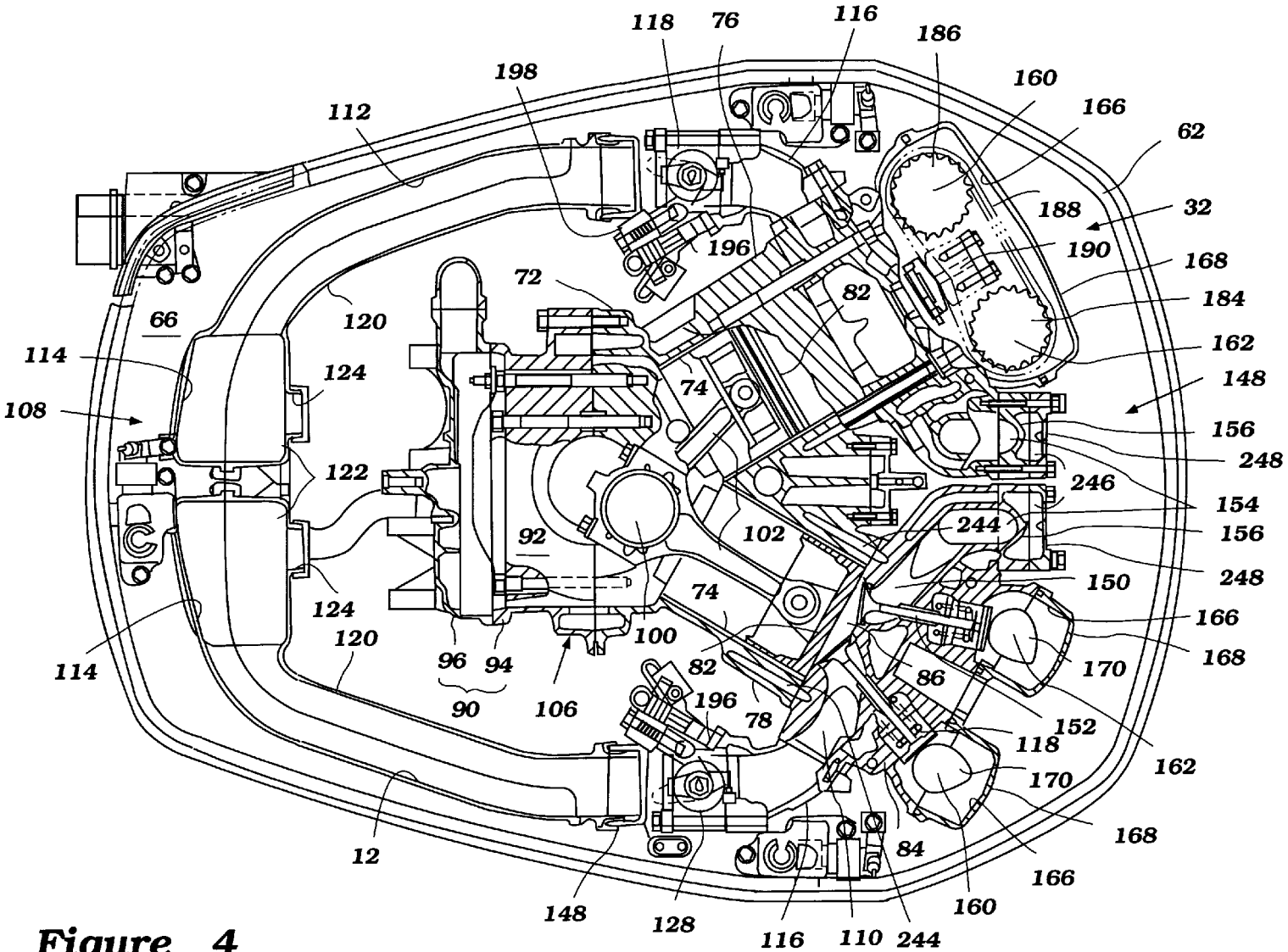
FIG. 4 is another top plan view of the power head. The top cowling member thereof is also detached. The engine is illustrated in section. The vapor separator is also omitted in this figure.

The engine 32 in the illustrated embodiment operates on a four-cycle combustion principle and powers a propulsion device. The engine 32 has a cylinder block 72. The presently preferred cylinder block 72 defines six cylinder bores 74 (FIG. 4). Three cylinder bores 74 extend generally horizontally and are vertically spaced from one another to form a first cylinder bank 76. The other three cylinder bores 74 also extend generally horizontally and are vertically spaced from one another to form a second cylinder bank 78. As seen in FIG. 4, the first bank 76 is located on the starboard side, while the second bank 78 is located on the port side. Both of the banks 76, 78 preferably intersect at an angle so that the engine 32 is generally V-configured. Although the cylinder bores 74 which are disposed next to each other horizontally are shown as positioned at the same level in FIG. 4, these bores 74 preferably are slightly offset vertically from one another, as known in the art.

This type of engine, however, merely exemplifies one type of engine on which various aspects and features of the present invention can be most suitably used. Engines having other number of cylinders, having other cylinder arrangements, and operating on other combustion principles (e.g., crankcase compression two-stroke or rotary) all can be used with certain features, aspects and advantages of the present invention.

Figure 6:
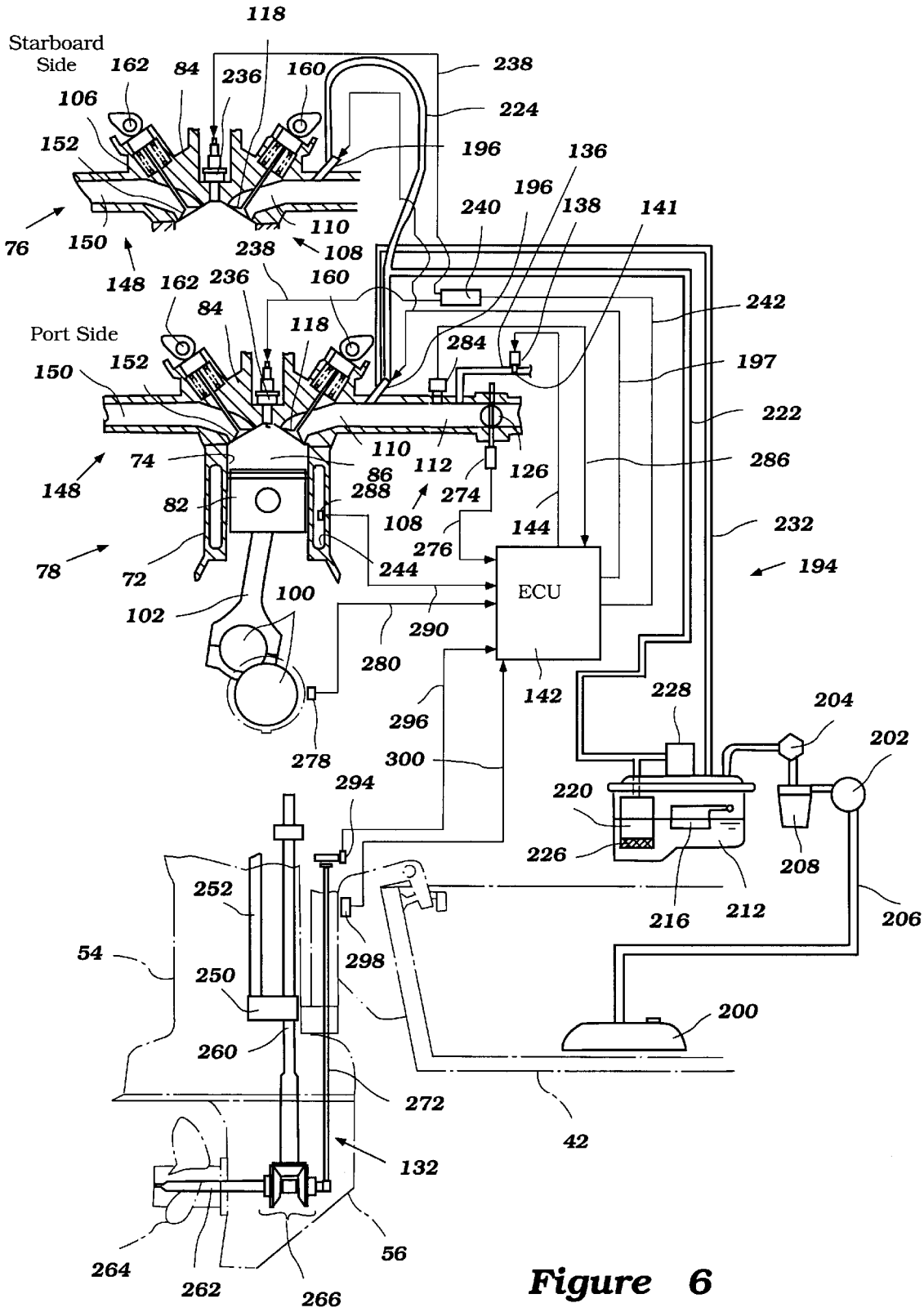
FIG. 6 is a schematic view of the outboard motor. Two head portions of the engine are generally shown in the upper portion of the figure. A portion of the outboard motor including a transmission and the associated watercraft are shown in the lower portion of the figure. An ECU and a fuel injection system link the two portions of the figure. The outboard motor and the associated watercraft are partially illustrated in phantom.

As seen in FIGS. 4 and 6, a piston 82 reciprocates in each cylinder bore 74. A pair of cylinder head members 84 is affixed to one end of the cylinder block 72 for closing the cylinder bores 74 of the respective banks 76, 78. Each cylinder head member 84 preferably defines three combustion chambers 86 at each bank 76, 78 together with the associated pistons 82 and cylinder bores 74. The engine 32 thus has six combustion chambers 86 in total.

A crankcase assembly 90 closes the other end of the cylinder bores 74 and defines a crankcase chamber 92 together with the cylinder block 72. In the illustrated embodiment, the crankcase assembly 90 comprises a crankcase member 94 and a crankcase cover member 96. The crankcase assembly 90 of course can be defined by a single piece. A crankshaft 100 extends generally vertically through the crankcase chamber 92 and is journaled for rotation by several bearing blocks. Connecting rods 102 couple the crankshaft 100 with the respective pistons 82 for rotation with the reciprocal movement of the pistons 82.

Preferably, the crankcase assembly 90 is located at the most forward position, with the cylinder block 72 and the cylinder head member 84 extending rearward from the crankcase assembly 90, one after another. Generally, the cylinder block 72, the cylinder head member 84 and the crankcase assembly 90 together define an engine body 106. These engine components 72, 84, 90 preferably are made of aluminum alloy.

The engine 32 includes an air induction system 108. The air induction system 108 draws air to the combustion chambers 86 from the cavity 66 of the protective cowling assembly 58. The air induction system 108 preferably includes intake ports 110, a pair of intake passages 112 and a pair of plenum chambers 114.

In the illustrated embodiment, twelve intake ports 110 are provided, six of which are disposed at the first cylinder bank 76, while another six of which are disposed at the second cylinder bank 78. That is, each cylinder bore 74 preferably has two intake ports 110. The intake ports 110 are defined in the respective cylinder head members 84 on the outer sides of the respective cylinder banks 76, 78. Intake valves 118, each associated with the individual intake port 110, repeatedly open and close the respective intake ports 110. The valves 118 normally close the intake ports 110 due to biasing force by valve springs. That is, the valves 118 block the air to be drawn to the combustion chambers 86 when they are in the closing or block position.

Three intake passages 112 extend from the respective intake port pairs 110 of the bank 76 generally along a side surface of the cylinder block 72 and the crankcase assembly 90 on the starboard side, while another three intake passages 112 extend from the intake port pairs 110 of the other bank 78 along the other side surface of the cylinder block 72 and the crankcase assembly 90 on the port side. When each intake port pairs 110 is opened, the corresponding intake passage 112 communicates with the associated combustion chamber 86.

Figure 2:
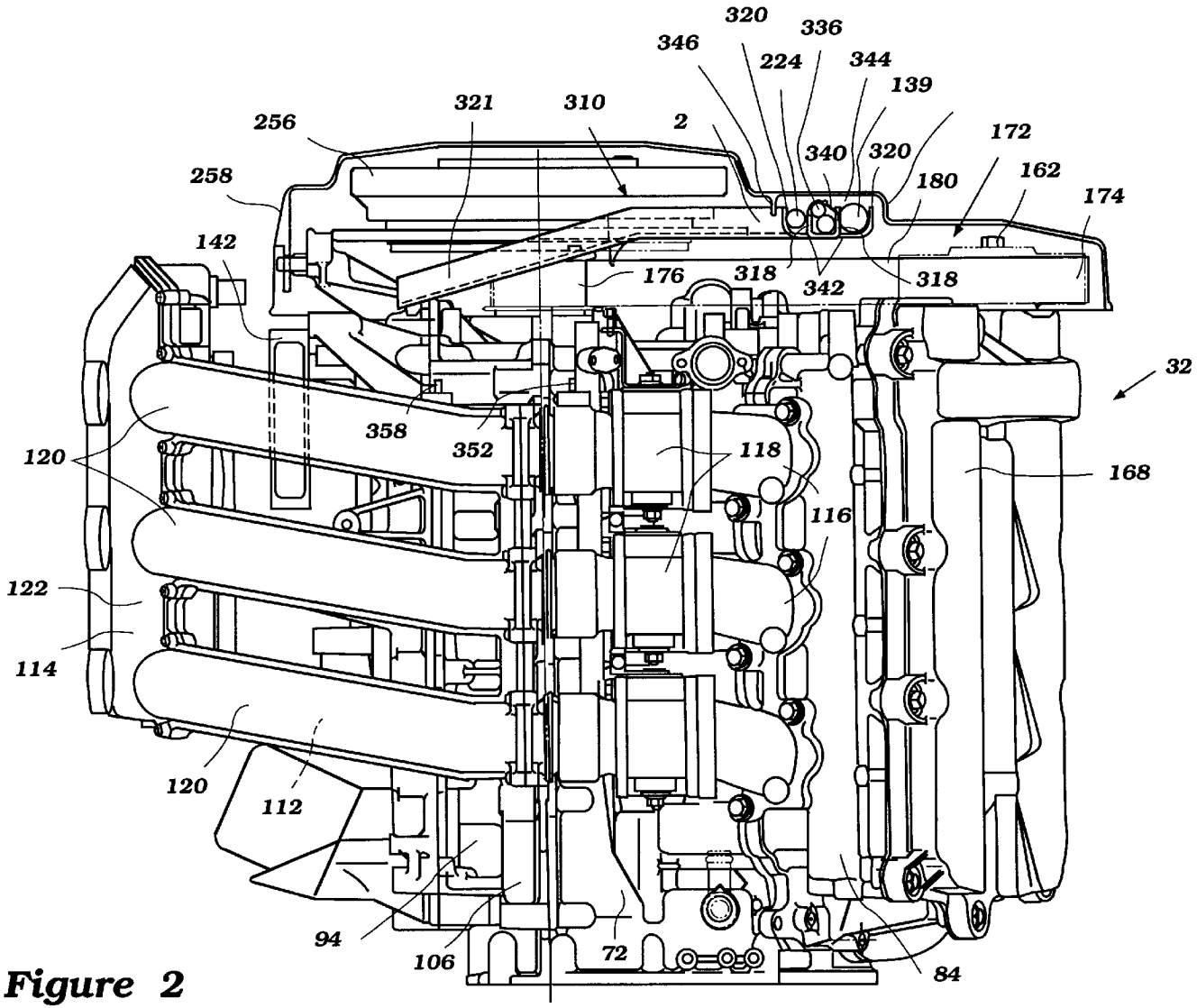
FIG. 2 is a side elevational view of the engine. A portion of a guide member positioned rearward of sectional line 2 is illustrated in section. A protective cover is illustrated in section. The vapor separator also is omitted in this figure.

The air intake passages 112 are actually defined by intake manifolds 116, throttle bodies 118 and intake runners 120, while the plenum chambers 114 are defined by a pair of plenum chamber members 122. In the illustrated embodiment, the intake manifolds 116, the throttle bodies 118, the intake runners 120 and the plenum chamber members 122 together form air intake conduits. Each intake manifold 116 is affixed to the cylinder head member 84. As best seen in FIG. 2, in the illustrated embodiment, the intake runners 120 on each bank 76, 78 are unitarily formed with one of the plenum chamber members 122 on the same side. The throttle bodies 118 are interposed between the intake manifolds 116 and the intake runners 120. The respective plenum chambers 114 are thus coupled to the associated intake port pairs 110 through the intake passages 112 defined by the intake runners 120, the throttle bodies 118 and the intake manifolds 116.

The intake manifolds 116 and the throttle bodies 118 preferably are made of aluminum alloy. Each combination of the intake runners 120 with the plenum chamber member 122 preferably is made of plastic material or aluminum alloy and is produced by, for example, a conventional cast method. Of course, these engine components can be made of other materials and by other conventional manufacturing processes.

Each plenum chamber member 122 has an inlet port 124 (FIG. 4) communicating to the plenum chamber 114. The respective plenum chambers 122 preferably are coupled together through a coupling pipe so as to balance the air flowing through the respective intake passages 112.

Figure 7:
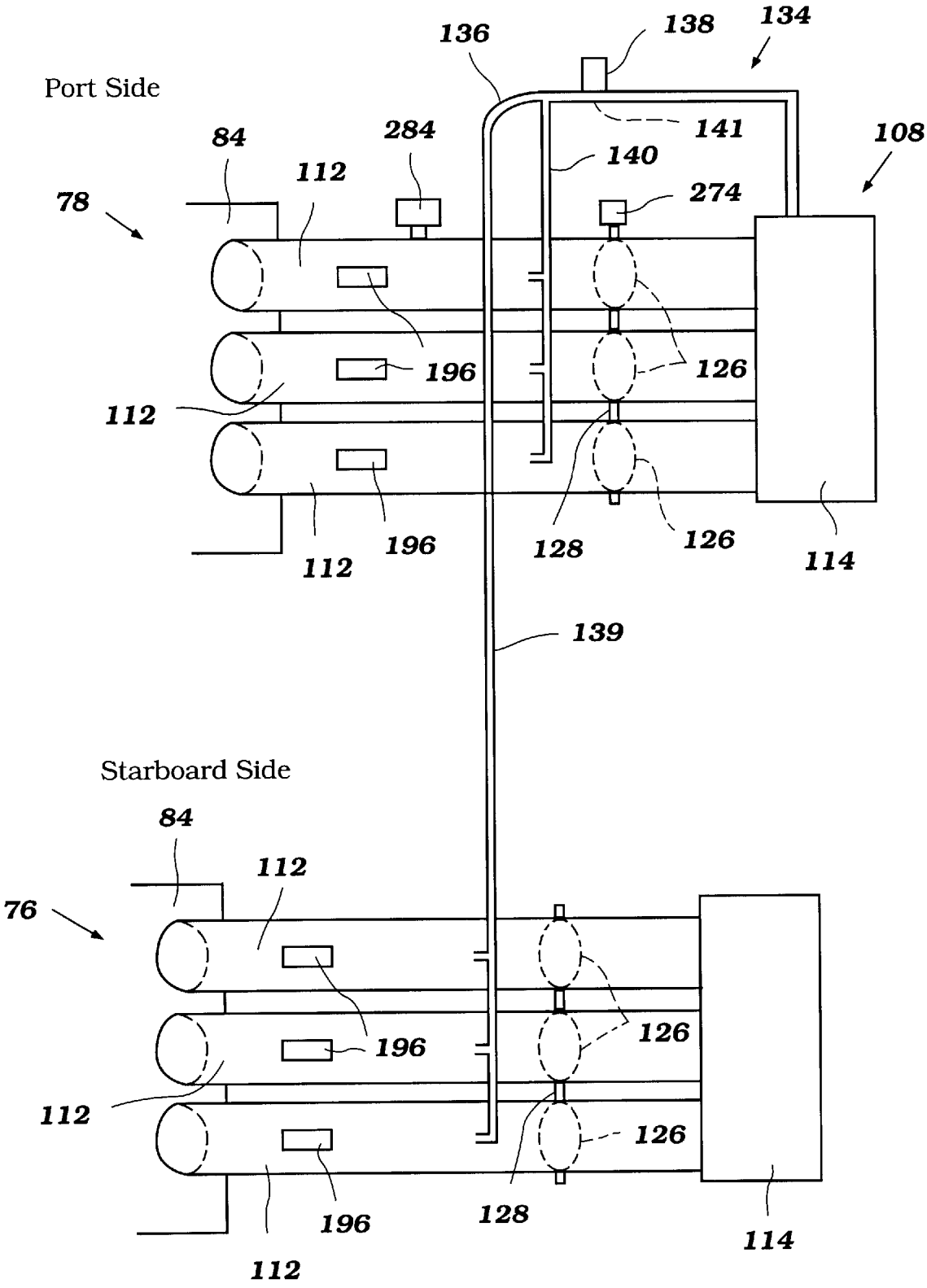
FIG. 7 is a schematic view of an air induction system of the engine. Part of the system on the port side is shown in the upper portion of the figure. Another part of the system on the starboard side is shown in the lower portion of the figure. An idle air supply unit including idle air conduits links the two portions of the figure.

As best seen in FIGS. 6 and 7, the respective throttle bodies 118 on each cylinder bank 76, 78 preferably journal throttle valves 126 for pivotal movement about an axis of a valve shaft 128 which extends generally vertically. In the illustrated embodiment, the throttle valves 126 are butterfly valves. The throttle valves 126 are operable by the operator through an appropriate conventional throttle valve linkage. The throttle valves 126 measure or regulate an amount of air flowing through the respective air intake passages 112. In other words, the air amount is variable by changing the positions or opening degrees of the throttle valves 126. Normally, the greater the opening degree, the higher the engine speed.

When the throttle valves 126 are closed, air cannot be supplied to the combustion chambers 86. In general, an engine ceases its operation without air. Air is necessary to keep the engine 32 at least under an idle speed condition. Moreover, the outboard motor 30 is often used for a trolling purpose. Under the trolling operation, a shift mechanism 132 (FIG. 6), which will be described later, is in a forward position and the engine 32 operates in the idle speed. Occasionally the engine 32 is required to operate even in a speed less than the idle speed. Because of these needs or requirements, the air induction system 108 in the embodiment includes an idle air supply unit 134 as best seen in FIG. 7.

The idle air supply unit 134 comprises a bypass conduit 136 and an ISC (idle speed control) vale 138. The bypass conduit 136 extends from the plenum chamber 114 for the cylinder bank 78 of this port side and bifurcates to the three intake passages 112 for the bank 78 on the port side and also to the other three intake passages 112 for the bank 76 of the starboard side so as to bypass all of the respective throttle valves 126. Because the intake passages 112 on the starboard side are spaced apart from the intake passages 112 on the port side, a first conduit member 139, which is longer than a second conduit member 140, extends toward the intake passages 112 on the starboard side from the bifurcated portion.

The ISC valve 138 is positioned on the bypass conduit 136 upstream of the bifurcated portion. The ISC valve 138 preferably includes a needle valve element 141 which is moveable for adjusting an idle air amount passing through the bypass conduit 136. A step motor preferably actuates the needle valve element 141. An ECU (electronic control unit) 142 (FIG. 6) controls rotation of the step motor through a control signal line 144. Idle air is thus supplied to the combustion chambers 86 through the idle bypass conduit 136, and the ISC valve 138 adjusts the idle air amount under control of the ECU 142. The ECU 142 will be described in greater detail shortly.

The engine 32 also includes an exhaust system 148 that discharges the burnt charges or exhaust gases to a location outside of the outboard motor 30. Twelve exhaust ports 150 (FIG. 4) are provided, six of which are disposed at the first cylinder bank 76 on the starboard side, and another six of which are disposed at the second cylinder bank 78 on the port side. That is, each cylinder bore 74 has two exhaust ports 150. The exhaust ports 150 are defined in the respective cylinder head members 84 opposite to the intake ports 110, i.e., on inner sides of the respective banks 76, 78. The exhaust ports 150 are repeatedly opened and closed by exhaust valves 152. The valves 152 normally close the exhaust ports 150 due to biasing force by valve springs like the intake valves 118.

The respective banks 76, 78 have an exhaust manifold 154 extending generally vertically and parallel to each other in a space defined between both banks 76, 78 so as to collect exhaust gasses from the respective exhaust port pairs 150. The exhaust manifolds 154 are defined by the cylinder head members 84 and exhaust manifold members 156. The respective exhaust manifolds 154 are coupled together downstream and are connected to the exhaust passage 68 of the exhaust guide member 66. When the exhaust ports 150 are opened, the combustion chambers 86 communicate with the exhaust passage 68 through the exhaust manifolds 154.

A valve cam mechanism is preferably provided for actuating the intake and exhaust valves 118, 152. In the illustrated embodiment, each cylinder bank 76, 78 has an intake camshaft 160 and an exhaust camshaft 162. Both shafts 160, 162 extend generally vertically and in parallel to each other. Because of the foregoing positions of the intake and exhaust ports 110, 150, both the exhaust camshafts 162 are positioned next to each other, and the respective intake camshafts 160 are spaced apart from each other. That is, both the intake camshafts 160 interpose both the exhaust camshafts 162 therebetween. Of course, other arrangements also can be used. For instance, the arrangement can be reversed or the arrangement could alternate between exhaust and intake camshafts.

The respective camshafts 160, 162 extend within camshaft chambers 166 that are defined by the cylinder head members 84 and camshaft covers 168. The camshafts 160, 162 are journaled by the cylinder head members 84 and are rotatably affixed thereto by camshaft caps. The intake camshafts 160 actuate the intake valves 118, while the exhaust cam shafts 162 actuate the exhaust valves 152. The respective camshafts 160, 162 have cam lobes 170 to push the intake and exhaust valves 118, 152 at any desired timing to open and close the intake and exhaust ports 110, 150, respectively. A single camshaft can replace the intake and exhaust camshafts 160, 162 at each cylinder bank 76, 78 in a manner that is well known. Other conventional valve cam mechanisms can be of course employed instead of such a mechanism using one or more camshafts.

Figure 3:
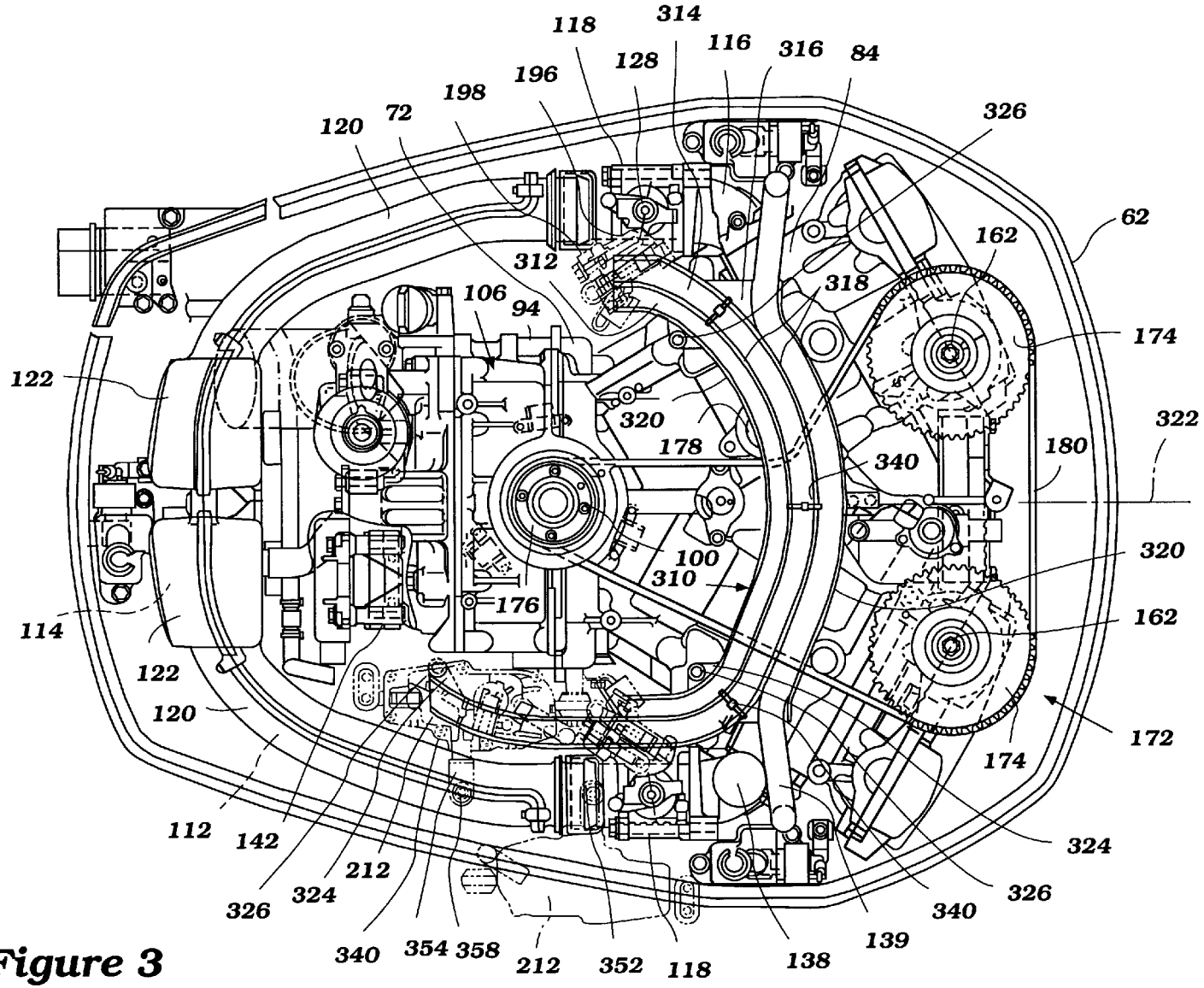
FIG. 3 is a top plan view of the power head. A top cowling member thereof is detached. A flywheel assembly is removed in this figure.

A drive mechanism 172 is provided for driving the valve cam mechanism. As seen in FIG. 3, the crankshaft 100 drives the exhaust camshafts 162. Each exhaust camshaft 162 has a driven sprocket 174 fitted atop thereto, while the crankshaft 100 has a drive sprocket 17(6 fitted thereto. A timing chain or belt or endless transmitter 180 is wound around the drive and driven sprockets 176, 174. The crankshaft 100 thus drives the exhaust camshafts 148 through the timing chain 180 in a timed relationship. A guide or idle roller 178 preferably abuts on a side of the timing chain 180 so as to guide the chain 180 and to maintain appropriate tension on the chain 180. A diameter of the driven sprockets 174 is twice as large as a diameter of the drive sprocket 176. The exhaust camshafts 162 thus rotate in the half speed of the rotation of the crankshaft 100.

As seen in FIG. 4, the respective exhaust camshafts 162, in turn, drive the intake camshaft 146 of the same bank 76, 78. The exhaust camshafts 162 have drive sprockets 184, while the intake camshafts 160 have driven sprockets 186. Timing chains or belts or endless transmitters 188 are wound around the respective drive and driven sprockets 184, 186. Chain guide members 190 are provided for guiding the chains 188. Thus, when the exhaust camshafts 162 rotate, the intake camshafts 160 also rotate. Because a diameter of the drive sprockets 184 is the same as a diameter of the driven sprockets 186, the rotation of the intake camshafts 160 is synchronized with the rotation of the exhaust camshafts 162. Thus, in the illustrated embodiment, the crankshaft 100, the drive sprockets 176, 184 the driven sprockets 174, 186 and the timing chains 180, 188 together define the drive mechanism 172.

As best seen in FIG. 6, the engine 32 preferably has port or manifold fuel injection system 194. The fuel injection system of the illustrated embodiment preferably includes six fuel injectors 196 with one fuel injector allotted for each of the respective combustion chambers 86. Each fuel injector 196 preferably has an injection nozzle directed toward the associated intake passage 112 adjacent to the intake ports 110. The fuel injector 196 also preferably has a plunger that normally closes the nozzle and solenoid coil that moves the plunger from the closed position to an open position when energized by electric power.

The fuel injectors 196 spray fuel into the intake passages 112 under control of the ECU 142. That is, the ECU 142 controls energizing timing and duration of the solenoid coils through a control signal line 197 so that the plungers open the nozzles to spray a desired amount of the fuel. Fuel rails 198 (FIGS. 3 and 4), which are rigid metal pipes, support the fuel injectors 196 and also define fuel passages to the injectors 196. The fuel rails 198 preferably extend generally vertically in spaces defined between the cylinder block 72 and the throttle bodies 118 and can be affixed to the throttle bodies 118.

As seen in FIG. 6, the fuel injection system 194 further can include a fuel supply tank 200 that preferably is placed in the hull of the associated watercraft 42. In the illustrated arrangement, fuel is drawn from the fuel tank 200 by a first low pressure fuel pump 202 and a second low pressure pump 204 through a fuel supply conduit 206. The first low pressure pump 202 preferably is a manually operated pump. The second low pressure pump 204 preferably is a diaphragm-type pump that can be operated by, for example, one of the intake and exhaust camshafts 160, 162. In this instance, the second low pressure pump 204 is mounted on the cylinder head assembly 84. A quick disconnect coupling can be provided in the first conduit 206. Also, a fuel filter 208 can be positioned in the conduit 206 at an appropriate location.

From the second low pressure pump 204, the fuel is supplied to a vapor separator 212 through the remainder of the illustrated fuel supply conduit 206. In the illustrated embodiment, the vapor separator 212 is primarily mounted on the engine body 106. A bracket (no shown) preferably extends from the crankcase cover member 96. The vapor separator 212 is affixed to the bracket so as to overhang into a space defined between the engine body 106 and the intake ducts 120 for the cylinder bank 78 on the port side. The vapor separator 212 is also affixed to one of the intake ducts 120 on this side. The mounting structure of the vapor separator 212 and a method for mounting the vapor separator will be described in greater detail later. At the vapor separator end of the conduit 206, a float valve can be provided that is operated by a float 216 so as to maintain a substantially uniform level of the fuel contained in the vapor separator 212.

A high pressure fuel pump 220 is provided in the vapor separator 212. The high pressure fuel pump 220 pressurizes fuel that is delivered to the fuel injectors 196 through a delivery conduit 222. The high pressure fuel pump 220 in the illustrated embodiment preferably comprises a positive displacement pump. The construction of the pump 220 thus generally inhibits fuel flow from its upstream side back into the vapor separator 212 when the pump 220 is not running. Although not illustrated, a back-flow prevention device (e.g., a check valve) also can be used to prevent a flow of fuel from the delivery conduit 222 back into the vapor separator 212 when the pump 220 is off. This approach can be used with a fuel pump that employs a rotary impeller to inhibit a drop in pressure within the delivery conduit 222 when the pump 220 is intermittently stopped.

In the illustrated embodiment, the delivery conduit 222 is primarily connected to the fuel rail 198 mounted on the throttle bodies 118 on the port side. The fuel rail 198 thus defines a portion of the delivery conduit 222. The delivery conduit 222 is then bifurcated to form an extended portion 224 of the delivery conduit 222 that is connected the fuel rail 118 mounted on the throttle bodies 118 on the starboard side.

An electric motor 226 preferably drives the high pressure fuel pump 220. The motor 226 in the illustrated arrangement is unified with the pump 220 at its bottom portion. The drive motor 184 desirably is positioned in the vapor separator 212.

A pressure regulator 228 can be positioned along the fuel delivery conduit 222 at the vapor separator 212 and preferably limits the pressure that is delivered to the fuel injectors 196 by dumping the fuel back into the vapor separator 212.

A fuel return conduit 232 also is provided between the fuel injectors 196 and the vapor separator 212. Excess fuel that is not injected by the injector 196 returns to the vapor separator 212 through the return conduit 232.

A desired amount of the fuel is sprayed into the intake passages 110 through the injection nozzles at a selected timing for a selected duration that are controlled by the ECU 142 through the control signal line 197. Because the pressure regulator 228 controls the fuel pressure. the duration can be used to determine a selected amount of fuel that will be supplied to the combustion chambers 86. Various control strategies for the injection timing and injection duration can be applied so that the optimum engine operation or an operation near to the optimum operation can be realized.

Of course, the present invention also can be used with direct injected engines, in which the fuel is directly injected into the combustion chambers. Also, some features of the present invention can be used with carbureted engines as well.

The engine 32 further includes an ignition or firing system. Each combustion chamber 86 is provided with a spark plug 236 (FIG. 6) connected to the ECU 142 so that an ignition timing is also controlled by the ECU 142. The spark plug 236 has an electrode exposed into the associated combustion chamber 86 and ignites an air/fuel charge at a selected ignition timing. The ignition system preferably has an ignition coil 240 and an igniter (not shown) which are disposed between the spark plugs 236 and the ECU 142. The spark plugs 236 are connected to the ignition coil 240 through ignition lines 238, while the ignition coil 240 together with the igniter is connected to the ECU 142 through a control line 242. In order to enhance or maintain engine performance, the ignition timing can be advanced or delayed in response to various engine running conditions.

The ignition coil 240 is preferably mounted on the rear side of the engine body 106. FIG. 8 schematically illustrates a possible physical position of the ignition coil 240. Both of the ignition lines 238 extend from the ignition coil 240 to the respective spark plugs 230 of the banks 76, 78 along a rear surface of the engine body 106.

The ignition coil 240 is a combination of a primary coil element and a secondary coil element that are wound around a common core. Desirably, the secondary coil element is connected to the spark plugs 236, while the primary coil element is connected to the igniter. Also, the primary coil element is coupled with a power source so that electrical current flown s therethrough. The igniter abruptly cuts off the current flow in response to an ignition timing control signal from the ECU 142 and then a high voltage current flow occurs in the secondary coil element. The high voltage current flow forms a spark at each spark plug 236. Because the high voltage current flows through the ignition lines 238, high-tension cords are preferably used as the ignition lines 238.

In the illustrated engine 32, the pistons 82 reciprocate between top dead center and bottom dead center. When the crankshaft 100 makes two rotations, the pistons 82 generally move from top dead center to bottom dead center (the intake stroke), from bottom dead center to top dead center (the compression stroke), from top dead center to bottom dead center (the power stroke) and from bottom dead center to top dead center (the exhaust stroke). During the four strokes of the pistons 82, the respective camshafts 160, 162 make one rotation. The intake camshaft 160 actuates the intake valves 118 to open the intake ports 110 during the intake stroke, while the exhaust camshaft 162 actuates the exhaust valves 152 to open the exhaust ports 150 during the exhaust stroke.

Generally, at the beginning of the intake stroke, air is preferably introduced into the air intake passages 112 and fuel is preferably injected into the intake passage 112 by the fuel injectors 196. The air and the fuel are mixed to form the air/fuel charge in the combustion chambers 86. Generally at the beginning of the power stroke, the respective spark plugs 236 ignite the compressed air/fuel charge in the respective combustion chambers 86. The engine 54 thus continuously repeats the foregoing four strokes during its operation.

During the engine operation, heat builds in, for example, the cylinder block 72, the cylinder head members 84 and the exhaust manifolds 154. Water jackets 244 thus are provided for cooling at least the cylinder block 72 and the cylinder head members 84, and, additionally. other water jackets 246 are defined out of the exhaust manifolds 154 between the exhaust manifold members 156 and exhaust cover members 248. Cooling water is introduced into the water jackets 244, 246 by a water pump 250 (FIG. 6) from the body of water surrounding the outboard motor 30 through a water supply conduit 252 and is returned to the body of water after circulating through the cooling jackets 244, 246. Thus, the engine 32 employs an open-loop type cooling system.

The engine 32 can be provided with other systems such as a lubrication system which are w ell known in this art. The lubrication system can be closed-loop type and can includes a lubricant oil reservoir preferably positioned within the driveshaft housing 54, an oil pump pressurizing the oil in the reservoir, lubricant delivery passages through which the pressurized oil is delivered to engine portions that need lubrication and a lubricant return passages through which the oil that has lubricated the portions returns to the oil reservoir.

In the illustrated arrangement, a flywheel assembly 256 is affixed atop the crankshaft 100. The flywheel assembly 256 preferably includes an AC generator or flywheel magneto that supplies electric power to electrical components including the fuel injection system 194, the ignition system and the ECU 142. A starter motor is provided for driving the crankshaft 100 to start the engine 32. The starter motor has a gear portion that meshes with a ring gear of the flywheel assembly 256. When the engine 32 starts, the starter motor drives the crankshaft 100 through the gear connection. Once the engine 32 starts, the starter motor immediately ceases operation to reduce the likelihood that the starter mechanism will be damaged.

The AC generator generates AC power and the power preferably is sent to a battery which is preferably placed in the hull of the watercraft 42 through a rectifier-regulator. The rectifier-regulator converts the AC power to DC power and regulates current and voltage of the power. The DC power of the battery preferably is supplied to the ECU 142 through a power supply line via a main switch.

A protective cover 258 can be detachably affixed atop the engine body 106 and can extend over at least a portion of the flywheel assembly 256 and the drive mechanism 172. The protective cover 258 will be described in greater detail later.

As best seen in FIG. 1, the driveshaft housing 54 depends from the power head 52 and supports a driveshaft 260 which is driven by the crankshaft 100. The driveshaft 260 extends generally vertically through the driveshaft housing 54. The driveshaft 260 preferably drives the water pump 250 and the oil pump. The driveshaft housing 54 also defines internal passages which form portions of the exhaust system 148.

The lower unit 56 depends from the driveshaft housing 54 and supports a propulsion shaft 262, which is driven by the driveshaft 260. The propulsion shaft 262 extends generally horizontally through the lower unit 56. In the illustrated arrangement, the propulsion device is a propeller 264 that is affixed to an outer end of the propulsion shaft 262 and is driven thereby. The propulsion device, however, can take the form of a dual counter-rotating system, a hydrodynamic jet, or any of a number of other suitable propulsion devices.

A transmission 266 is provided between the driveshaft 260 and the propulsion shaft 262. The transmission 266 couples together the two shafts 260, 262 which lie generally normal to each other (i.e., at a 90° shaft angle) with bevel gears. The outboard motor 30 has the foregoing shift mechanism or clutch mechanism 132 that allows the transmission 246 to shift the rotational direction of the propeller 264 among forward, neutral or reverse.

In the illustrated arrangement, the shift mechanism 132 includes a shift cam 270, a shift rod 272 and a shift cable or shift linkage. The shift rod 272 extends generally vertically through the steering shaft 47 and the lower unit 56. The shift cable extends through the bottom cowling member 62 and then forwardly to a manipulator which is located next to a dashboard in the associated watercraft 42. The manipulator has a shift lever which is operable by the watercraft operator.

When the shift mechanism 132 is in the forward or reverse position, the propulsion shaft 262 cain rotate the propeller 264 in the forward or reverse direction, respectively, and the watercraft 42 thus can move forwardly or backwardly, respectively. When the shift mechanism 132 is in the neutral position, the propulsion shaft 262 cannot rotate the propeller 264 and the watercraft 42 stands still. Under this condition, normally the engine operation is kept in an idle speed. Occasionally, while engine operation is kept in or under the idle speed, the shift mechanism 132 is in the forward position. This is the foregoing trolling condition.

The lower unit 56 also defines an internal passage that forms a discharge section of the exhaust system 148. At engine speed above idle, the majority of the exhaust gases are discharged to the body of water surrounding the outboard motor 30 through the internal passage and finally through an outlet passage defined through the hub of the propeller 264. Of course, an above-the-water discharge can be provided for lower speed engine operation.

The preferred ECU 142 stores a plurality of control maps or equations related to various control routines. In order to determine appropriate control indexes in the maps or to calculate them using the equations based upon the control indexes determined in the maps, various sensors are provided for sensing engine conditions and other environmental conditions.

As seen in FIGS. 6 and 7, a throttle valve position sensor 274 is provided proximate the valve shaft 128 to sense an opening degree or opening position of the throttle valves 126. A sensed signal is sent to the ECU 142 through a sensor signal line 276. Of course, the signals can be sent through hard-wired connections, emitter and detector pairs, infrared radiation, radio waves or the like. The type of signal and the type of connection can be varied between sensors or the same type can be used with all sensors. The sensed signal also can be used to determine a rate of change of the throttle valve position.

Associated with the crankshaft 100 is a crankshaft angle position sensor 278 which, when measuring crankshaft angle versus time, outputs a crankshaft rotational speed signal or engine speed signal that is sent to the ECU 142 through a sensor signal line 280, for example. The sensor 278 preferably comprises a pulsar coil positioned adjacent to the crankshaft 100 and a projection or cut formed on the crankshaft 100. The pulsar coil generates a pulse when the projection or cut passes proximate the pulsar coil. In some arrangement, the number of passes can be counted. The sensor 278 thus can sense not only a specific crankshaft angle but also a rotational speed of the crankshaft 100. Of course, other types of speed sensors also can be used.

An air intake pressure sensor 284 is positioned along one of the intake passages 112, preferably at the uppermost intake passage 112, at a location downstream of the throttle valve 126. The intake pressure sensor 284 primarily senses the intake pressure in this passages 112 during the engine operation. The sensed signal is sent to the ECU 142 through a sensor signal line 286, for example. This signal can be used for determining engine load.

A water temperature sensor 288 at the water jacket 244 sends a cooling water temperature signal to the ECU 142 through a sensor signal line 290, for example. This signal represents engine temperature.

A shift position sensor 294 sends a signal indicating a position of the shift rod 272 (forward, neutral or reverse) to the ECU 142 through a sensor signal line 296, for example.

A trim position sensor 298 is preferably affixed to the clamping bracket 46 so as to sense a trim position of the swivel bracket 44. A trim position signal is sent to the ECU 142 through a sensor signal line 300.

Of course, various other sensors such as an oxygen ($O_2$) sensor, a lubricant pressure sensor and a lubricant temperature sensor can be provided for the control by the ECU 142.

As seen in FIGS. 2 and 3, the ECU 142 is preferably located at a top forward surface of the crankcase cover member 96 on the port side. Although not shown, both the shift position sensor 294 and the trim position sensor 298 are located on the starboard side.

As described above, a number of electrical wires and fluid conduits extend around the engine body 106. In addition, because the engine 32 is configured V-shape and has two banks 76, 78, most of the wires and conduits need two sets and hence routing the wiring and piping can be extremely complicated. In the illustrated embodiment, therefore, a guide member 310 is provided for guiding or bundling the wires and piping.

With primary reference to FIG. 3, 5 and 8 and still reference to FIGS. 1, 2, 4, 6 and 7, the guide member 310 and an exemplary arrangement of a wire harness, which is a bundle the wires, and fluid conduits will now be described. As best seen in FIGS. 3 and 8, in the illustrated embodiment, the guide member 310 is generally shaped as an arc in a top plan view. The guide member 310 preferably is made of plastic or synthetic resin and can be produced by a die-casting method. The guide member 310 preferably has a forward groove 312, a middle groove 314 and a rear groove 316 that are generally defined by two upstanding partitions 318 and two upstanding outer walls 320. All of the grooves 312, 314, 316 thus open upwardly.

In the illustrated arrangement, the forward groove 312 extends generally between the respective fuel rails 198 on the starboard and port sides while the middle groove 314 extends between a location adjacent to the fuel rail 198 on the starboard side and a location adjacent to the vapor separator 212. Actually, both the forward and middle grooves 312, 314 preferably extend along one another except a portion 321 of the middle groove 314 which further extends beyond the forward groove 312. As best seen in FIG. 2, the extended portion 321 desirably slopes forwardly. The rear groove 316 also can extend along the grooves 312, 314 but, because it is shorter than the other grooves 312, 314, it does not reach the locations of the fuel rails 198. Rather, the rear groove 316 in the illustrated arrangement ends at generally equal distances from a center plane 322 extending generally vertically fore to aft of the outboard motor 30. Both ends of the respective grooves 312, 314 generally forwardly open, and both ends of the groove 316 open generally laterally. That is, no standing walls are formed at those ends in the illustrated arrangement.

The guide member 310 thus extends generally over the engine body 106. More preferably, the guide member 310 also extends traversely over the drive mechanism 172. In other words, the guide member 310 is interposed between the drive mechanism 172 and the protective cover 258. Also, the guide member 310 preferably is spaced apart from the engine body 106 a distance that is greater than a distance with which the drive mechanism 172 is spaced apart from the engine body 106.

The illustrated guide member 310 has three mounting brackets 324. Two of the brackets extend generally forwardly from the forward groove 312 and are spaced apart from one another so as to be generally symmetrically placed relative to the vertical center plane 322. These brackets 324 preferably are affixed to the top surface of the cylinder block 72 by bolts 326. The other one of the brackets 324 desirably is positioned at the forward end of the middle groove 314 on the port side and extends generally laterally toward the center plane 322. This bracket 324 is preferably affixed to the top surface of the vapor separator 212.

Figure 5:
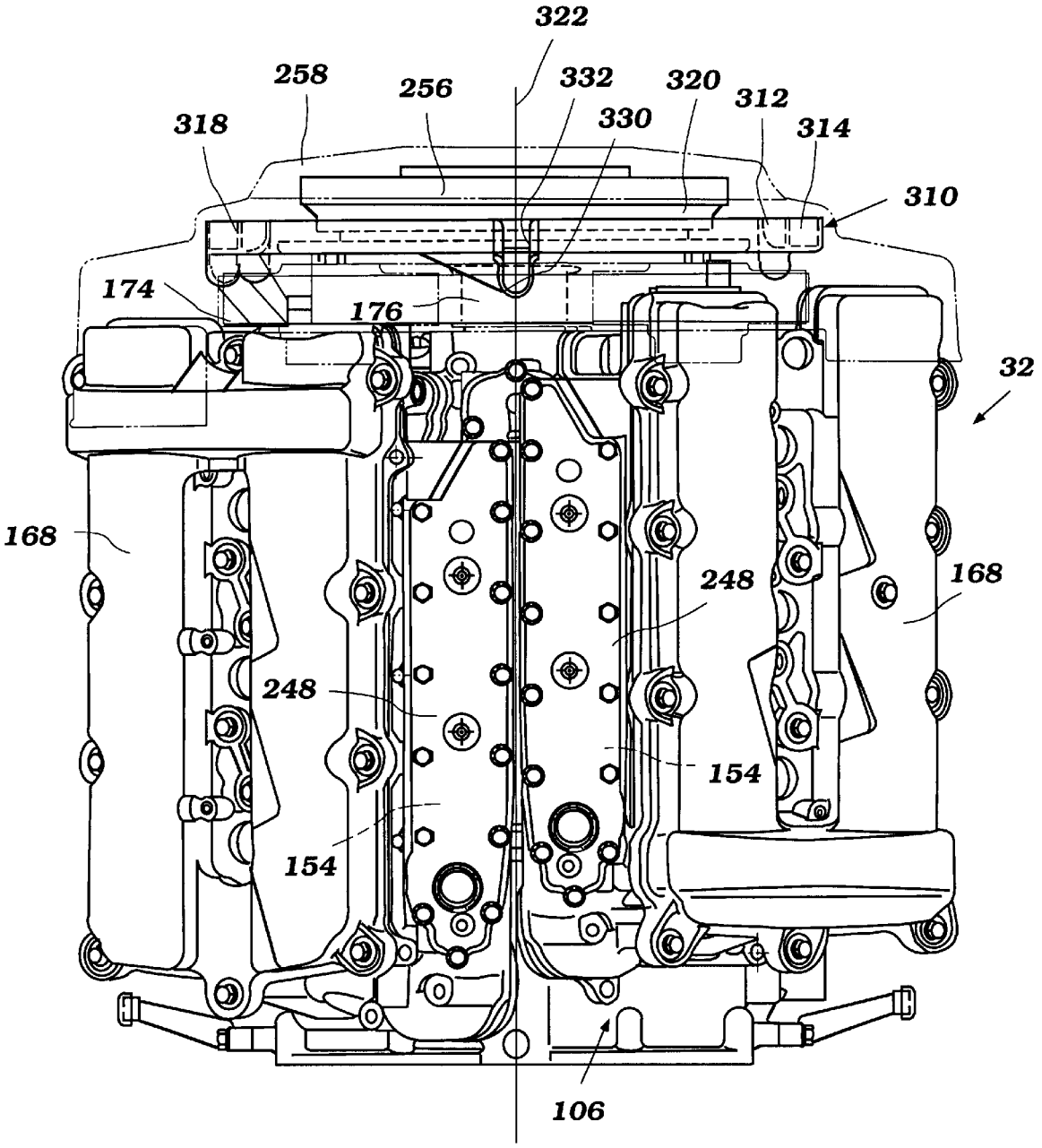
FIG. 5 is a rear view of the engine. A flywheel cover member is shown in phantom.

As seen in FIG. 5, the middle and rear grooves 314, 316 actually overlie an underpass or another groove 330 which extends rearward and normal to the grooves 314, 316 along the center plane 322 and which is deeper than the grooves 314, 316. The rear partition 31 8 and the rear wall 320 have cuts 332 corresponding to the underpass 330.

Figure 8:
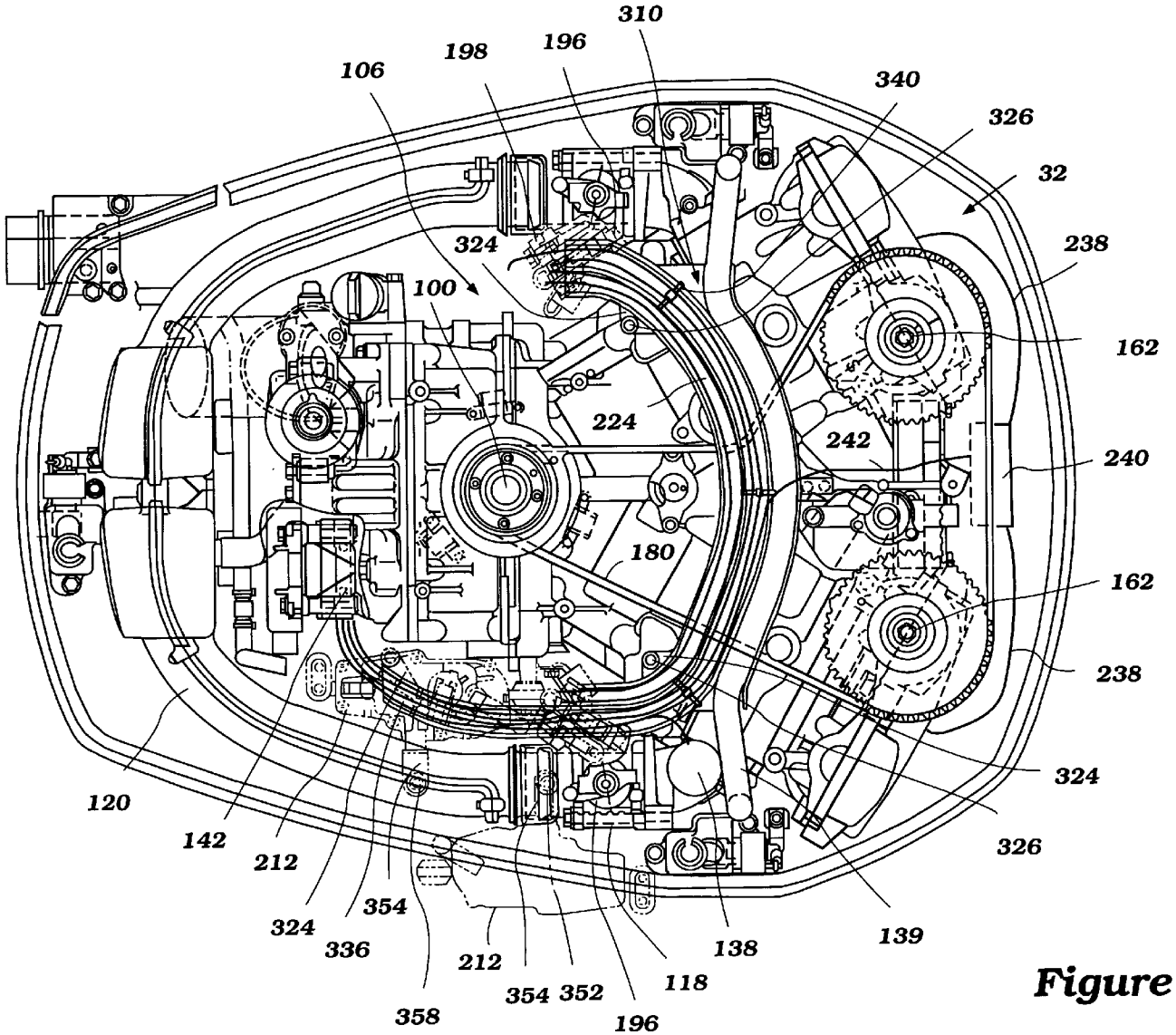
FIG. 8 is a top plan view of the power head that is generally the same as the view shown in FIG. 3 except for an exemplary arrangement of a wire harness and fluid conduits.

In the illustrated embodiment, as seen in FIGS. 3 and 8, the extended portion 224 of the fuel delivery conduit 222 extends along the forward groove 312 and is coupled with the full rails 198 on the both sides. The electrical wires including the control lines 144, 197, 242 and the signal lines 276, 280, 284, 290, 296, 300 are bundled to form a wire harness 336. The wire harness 336 is laid on the middle groove 314 in the illustrated arrangement. One end of the wire harness 336 is coupled with the ECU 142, while the other end of each of the wires extends along the middle groove 314 and is coupled with the associated component. The first conduit member 139 of the idle bypass conduit 136 extends along the rear groove 316. As described above, the first conduit member 139 comes from the plenum chamber 114 via the ISC valve 138 and is connected to the intake passages 112 on the starboard side.

As shown in FIG. 8, the end portion of the control line 242 extends rearwardly at a center portion of the rear groove 316. Although the first conduit member 139 extends across the control line 242, the underpass 330 and the cuts 332 allow the control line 242 to pass below the first conduit member 139 and then to go outwardly. The control line 242 thus extends over the exhaust cover member 248 and reaches the ignition coil 240.

It is advantageous that the wire harness 336 is spaced apart from the high-tension cords 238 because the high-tension cords 238 generally will not produce substantial noise in the wire harness 336 in this arrangement. The noise, if produced in a large enough amount, can harm the signals passing through the wire harness 336.

Three bands 340 are preferably provided to secure the wire harness 336 in the middle groove 314 of the guide member 310. One band 340 is located generally on the center plane 322, while the other two bands 340 are placed next to the respective mount brackets 324. It is sufficient that the bands 340 at least extend over the wire harness 336. Although a number of conventional structures can be applied, in the illustrated embodiment, the bands 340 surround the middle groove 314 as best seen in FIG. 2. That is, holes 342 are formed at the bottom surface of the guide member 310 on outer sides of the partitions 318. Each one end of the bands 340 passes through one of the holes 342 to extend to the other side and is then fastened to the other end of the band 340 above the wire harness 336.

In order to better secure the extended portion 224 of the fuel delivery conduit 222 and the first conduit member 139 of the bypass conduit 136 to the forward and rear grooves 312, 316, respectively, a space 344 (FIG. 2) that is defined between the bottom surface of the protective cover 258 and the top portions of the partitions 318 and outer walls 320 is preferably smaller than both diameters of the extended portion 224 and the first conduit member 139. To further secure the components in position, the protective cover 258 preferably has a rib 346 extending downwardly proximate the forward outer wall 320 and along the wall 320 for an appropriate length. Likewise, i.e., to secure the first conduit member 139 of the bypass conduit 136 to the rear groove 316, the protective cover 258 is configured to have a portion 348 extending downward proximate the rear outer wall 320 and along the wall 320 for an appropriate length. The rib 346 and the portion 348 can be formed continuously or intermittently.

As described above, the vapor separator 212 is placed in the space defined between the engine body 106 and the intake ducts 120. Also, at least three fuel conduits 206, 222, 232 are coupled with the vapor separator 212 adjacent at least one wire for powering the electric motor 226 that also is connected to the vapor separator 212.

Figure 9:
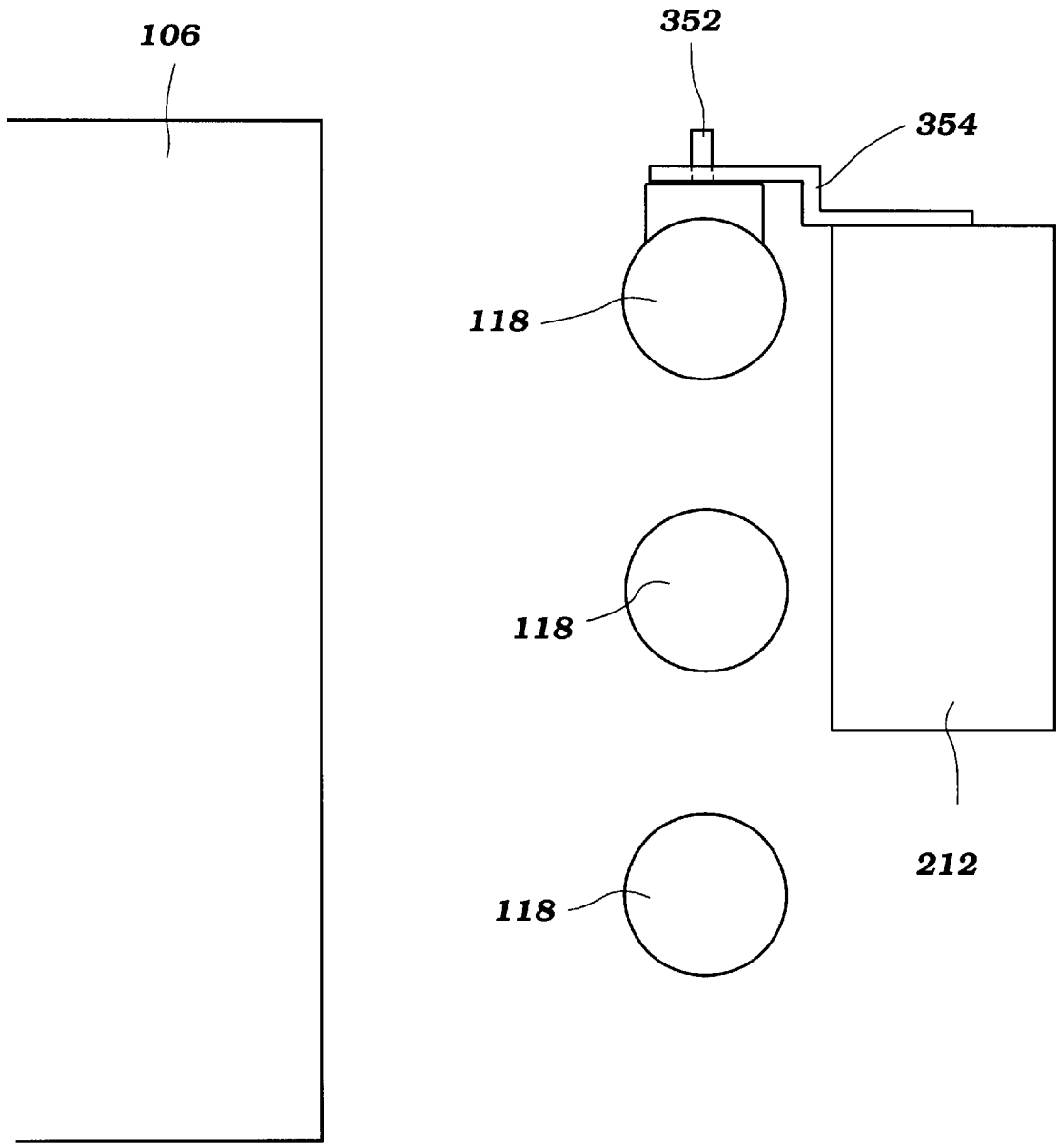
FIG. 9 is a schematic view showing a situation in which a vapor separator is temporarily positioned.
Figure 10:
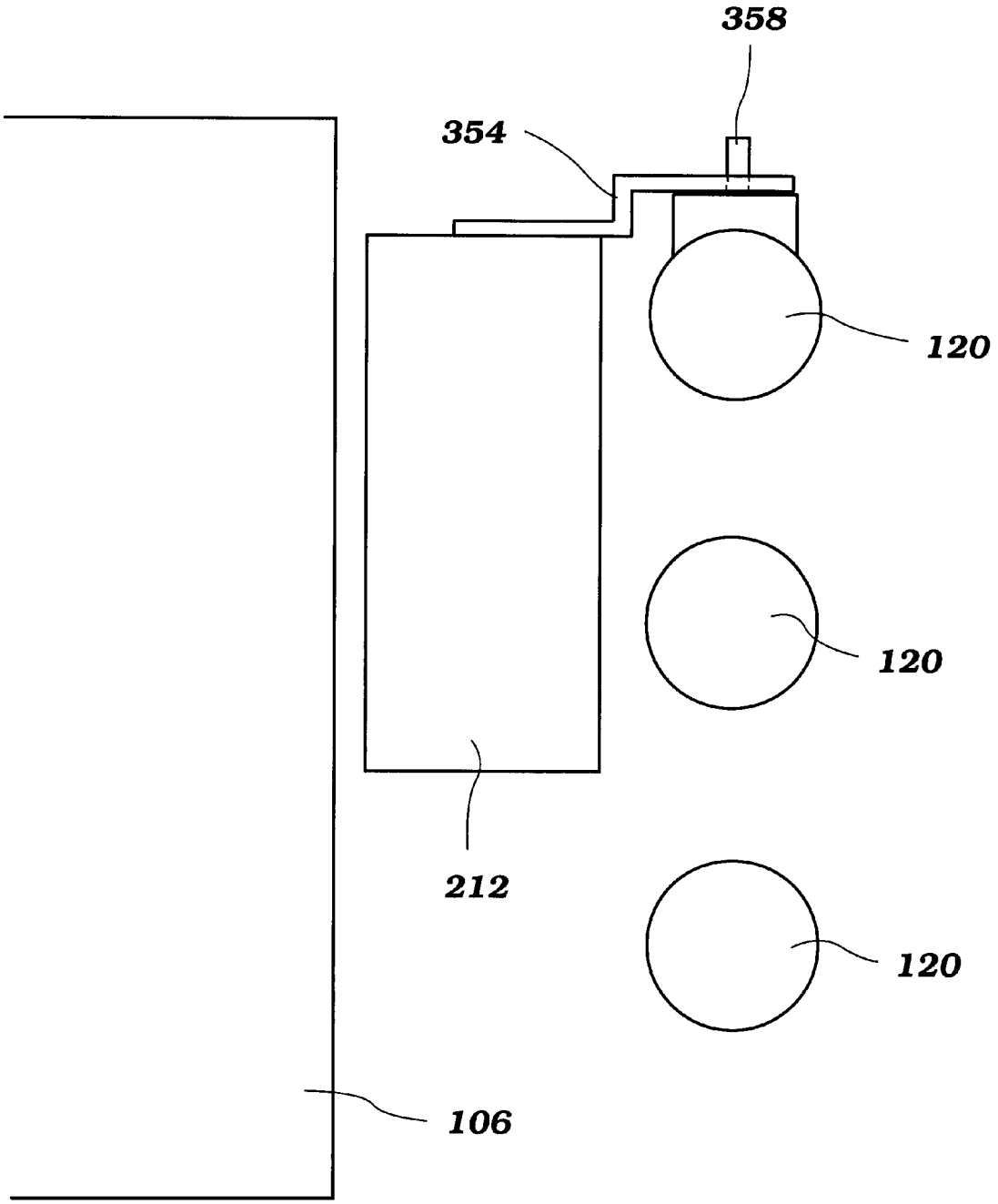
FIG. 10 is a schematic view showing a situation in which a vapor separator is normally positioned.

With primary reference to FIGS. 9 and 10 and still reference to FIGS. 3 and 8, a preferred construction and method for mounting the vapor separator 212 will be described. A first projection 352 extends upwardly atop the uppermost throttle body 118. The vapor separator 212 has a bracket 354 affixed atop thereof that extends generally horizontally. A through-hole is formed at an end portion of the bracket 354. Before attaching the piping and the wiring, the vapor separator 212 is temporarily mounted on the uppermost throttle body 118 in a manner such that the bracket 354 is engaged with the first projection 352 by the through-hole. As best seen in FIG. 9, the whole body of the vapor separator 212 is out of position. Under this condition, the piping and wiring connections can be made and the piping and the wiring can be mounted. Because the vapor separator 212 has not be mounted in position, the connections can be made without inference from other mechanical components. This increases the efficiency experienced in the assembly process.

Meanwhile, a second projection 358 extends upwardly atop the uppermost intake duct 120. After securing the piping and the wiring, the vapor separator 212 is removed from the throttle body 118 and is mounted on the uppermost intake duct 120 in a manner such that the bracket 354 is engaged with the second projection 358 by the through-hole. As best seen in FIG. 10, the whole body of the vapor separator 212 then is in its desired position. Under this condition, the bracket 354 is affixed to the second projection 358 in any suitable manner. For instance, the second projection 358 is threaded and a nut is fitted onto the threaded portion of the second projection 358 so as to fix the bracket 354 to the projection 358. Although not shown, a relatively large bracket extends toward the vapor separator 212 from the crankcase cover member 96. Another portion of the vapor separator 212 is affixed to the large bracket so that most weight of the vapor separator 212 is supported by the engine body 106.

Figure 11:
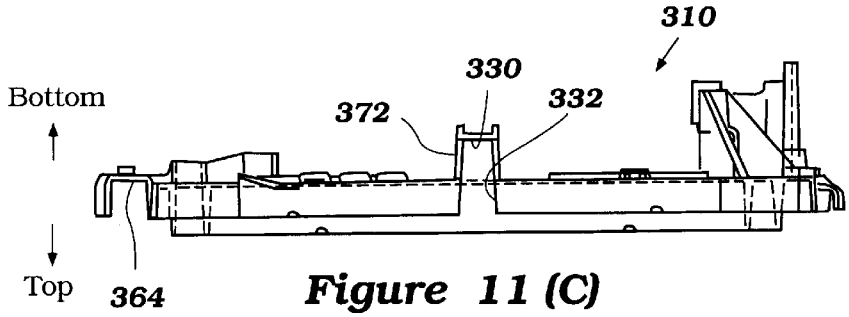
FIGS. 11(A)–(D) illustrate another configuration of the guide member.
Figure 11:
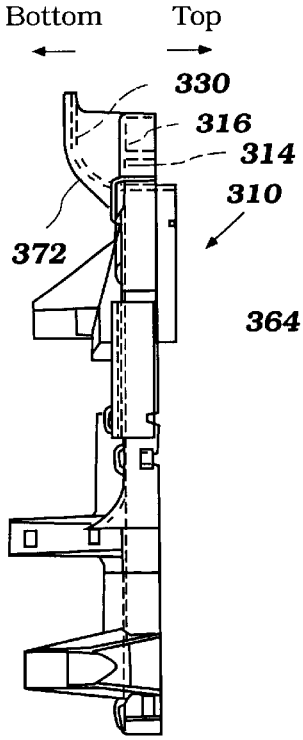
Figure 11:
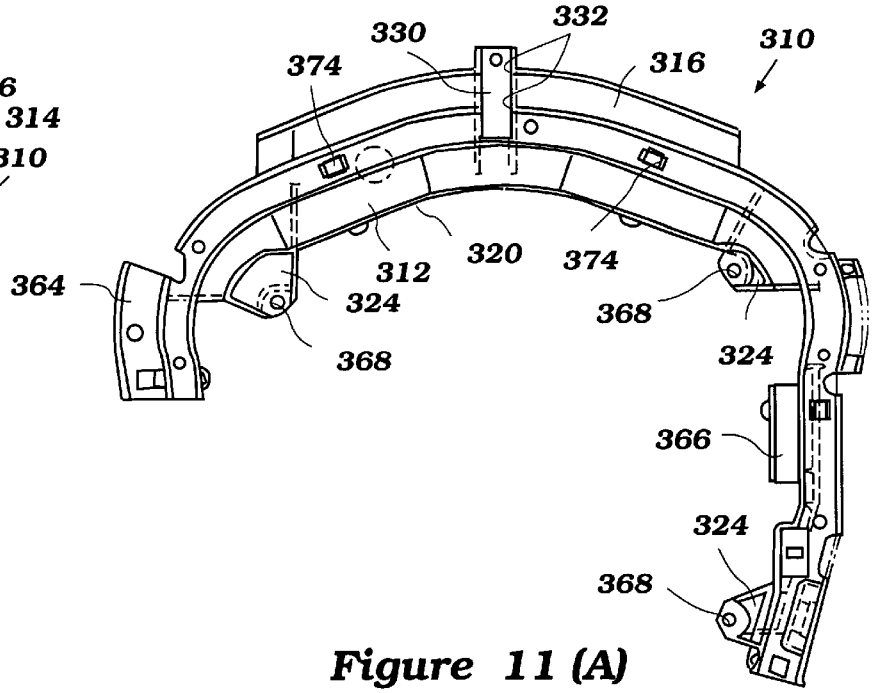
Figure 11:
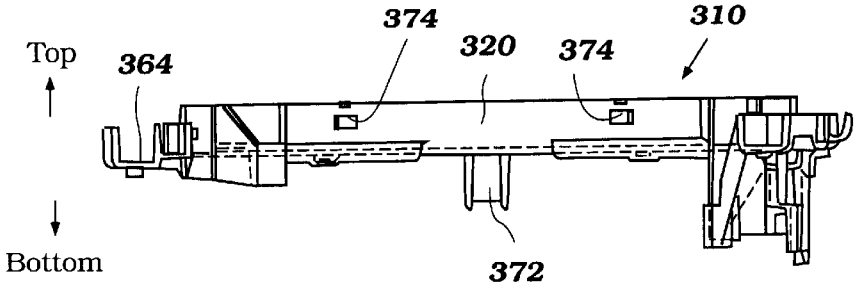

With reference to FIGS. 11 (A)–(D), another configuration of the guide member 310 will be described below. The same reference numerals will be assigned to the same parts and portions as those shown in FIGS. 1–10. Although this configuration of the guide member 310 is slightly different from that of the guide member 310 described above, a major portion of the construction is the same. This guide member 310 is also made of plastic and is produced by the die-casting method.

A foinvard groove 312, a middle groove 314 and a rear groove 316 are formed in the guide member 310. A fourth groove 364 and a fifth groove 366 are additionally formed in this configuration so as to guide another portion of the wire harness or fluid conduits. The guide member 310 also has three mount brackets 324 positioned at almost the same portions as those shown in FIGS. 3 and 8. The respective brackets 324 have bolt holes 368 through wlilch bolts 326 pass so as to fix the member 310 to the engine body 106.

An underpass 330 is formed normal to the middle and rear grooves 314, 316 at almost the center of the rear groove 316. Cuts 332 are also formed corresponding to the underpass 330. The underpass 330 in this configuration extends lower than the bottom surface of the member body. A lower projection 372 defines this portion of the underpass 330.

Several openings 374 are formed at the bottom surface of the middle groove 314 and a forward outer wall 320 so that part of wire harness and/or fluid conduits can extend out of the guide member 310 through these openings 374.

As described above, in the illustrated embodiment, the guide member can allow the wire harness and the fluid conduits to be neatly arranged around the engine. In addition, because the guide member extends over the drive mechanism and does not intersect with the drive mechanism, the wire harness and/or the fluid conduits should not be damaged by movement of the components of the drive mechanism. Moreover, there is no need to strengthen the crankshaft, camshafts and/or bearing constructions to avoid such incidental contact.

The guide member can have various configurations other than those described and shown in the figures. For instance, one or more U-shaped members can be separately mounted on the engine body. Such individual members further can be coupled with each other as desired or required, or the individual members can be entirely unified with one another. Also, L-shaped members can be attached both sides of a U-shaped member to form a configuration similar to those described above. Also, bottom surfaces of the respective grooves can be offset from each other. Grooves, underpasses, cuts and openings can be formed at any portions of the guide member in comply with configurations and/or positions of engines, engine components, wire harness and/or fluid conduits.

The guide member can be made of other materials than plastic. For instance, metal sheet or metal pipes can be used. Similarly, the guide member can be produced by other methods than the die-casting method. For instance, bending, cutting, bonding and/or welding of plaistic or metal material can be applied. Further, other casting and/or forging methods also can be practicable.

The guide member can be positioned at any location on the engine body. For instance, the guide member can extend over the crankcase assembly. The guide member can be placed on one or either side of the center plane if the drive mechanism is biased to this side.

Although the present invention has been described in terms of certain embodiments, other embodiments apparent to those of ordinary skill in the art also are within the scope of this invention. Thus, various changes and modifications may be made without departing from the spirit and scope of the invention. For instance, various components may be repositioned tis desired. Moreover, not all of the features, aspects and advantages are necessarily required to practice the present invention. Accordingly, the scope of the present invention is intended to be defined only by the claims that follow.

What is claimed is:

1. An internal combustion engine comprising a cylinder block defining at least one cylinder bore extending generally horizontally, a piston reciprocating within the cylinder bore, a cylinder head assembly closing an end of the cylinder bore to define, together with the cylinder bore and the piston, a combustion chamber, a crankshaft extending generally vertically and coupled with the piston so as to rotate with the reciprocal movement of the piston, an air induction system arranged to introduce air to the combustion chamber, the cylinder head assembly defining an intake port through which the air is drawn to the combustion chamber, a valve arranged to selectively open and close the intake port, a valve actuation mechanism disposed generally opposite to the crankshaft relative to the piston, a drive mechanism through which the crankshaft drives the valve actuation mechanism, the drive mechanism being disposed generally above the cylinder block and the cylinder head assembly, and at least one guide member arranged to guide at least one wire or fluid conduit of the engine, the guide member extending above the drive mechanism.

2. The engine as set forth in claim 1, wherein the guide member includes a bottom section and side sections extending generally upwardly from the bottom section so as to support the wire or fluid conduit.

3. The engine as set forth in claim 2, wherein the bottom section and the side sections are unitarily formed with one another.

4. The engine as set forth in claim 2, wherein the guide member is made of plastic.

5. The engine as set forth in claim 2 further comprising at least one holder arranged to prevent the wire or fluid conduit from slipping from the guide member.

6. The engine as set forth in claim 5, wherein the holder includes a band extending over the wire or fluid conduit.

7. The engine as set forth in claim 2 additionally comprising a cover member arranged to cover the guide member, wherein the cover member includes a vertical portion extending generally vertically along the side section.

8. The engine as set forth in claim 1, wherein the guide member defines open ends through which the wire or fluid conduit extends out of the guide member.

9. The engine as set forth in claim 1, wherein the guide member defines an opening at an intermediate portion of the guide member, and the wire or fluid conduit extends out the guide member from the opening.

10. The engine as set forth in claim 1 comprising at least two cylinder bores extending generally horizontally, the cylinder bores spaced apart from each other so as to form V-configured banks, and wherein the guide member extends to reach both the banks.

11. The engine as set forth in claim 1, wherein the guide member has at least one bracket at which the guide member is affixed to at least one of the cylinder block and the cylinder head assembly.

12. The engine as set forth in claim 1, wherein the guide member includes at least one groove guiding the wire or fluid conduit, and an underpass formed at a portion of the groove so as to allow part of the wire or fluid conduit to extend under the rest of the wire or fluid conduit.

13. The engine as set forth in claim 1 additionally comprising a charge forming mechanism arranged to supply an air/fuel charge in the combustion chamber, the air induction system supplying air to the combustion chamber, an ignition system arranged to fire the air/fuel charge in the combustion chamber, at least one sensor arranged to sense a condition of the engine, an electrical control unit configured to control at least the ignition system based upon a signal received from the sensor, wherein a first wire connects the sensor to the control unit and a second wire connects the control unit to the firing system and the guide member guides at least one of the first and second wires.

14. The engine as set forth in claim 1 additionally comprising a fuel injection system arranged to supply fuel to the combustion chamber, at least one sensor arranged to sense a condition of the engine, an electrical control unit configured to control at least the fuel injection system based upon a signal sensed by the sensor, wherein a first wire connects the sensor to the control unit and a second wire connects the control unit to the fuel injection system, and the guide member guides at least one of the first and second wires.

15. The engine as set forth in claim 1 additionally comprising a fuel injector arranged to spray fuel toward the combustion chamber, and wherein the fluid conduit delivers fuel to the fuel injector.

16. The engine as set forth in claim 1, wherein the air induction system including a main flow control mechanism arranged to regulate a first amount of air intake into the engine and an auxiliary flow control mechanism bypassing the main flow control mechanism so as to regulate a second amount of air intake into the engine under at least same operating conditions of the engine, the auxiliary flow control mechanism including an idle air conduit, and the fluid conduit within guide member is the idle air conduit.

17. The engine as set forth in claim 1, wherein the air induction system includes an air intake conduit communicating with the intake port, the intake conduit extends along a side surface of the cylinder block, and the guide member extends in parallel to the intake conduit at least in part.

18. The engine as set forth in claim 1, wherein the air induction system includes an air intake conduit communicating with the intake port, the intake conduit extends along a side surface of the cylinder block, the intake conduit has a temporary coupling portion at which an engine related component is temporarily affixed and a regular coupling portion at which the engine related component is normally affixed.

19. The engine as set forth in claim 1 additionally comprising a cover member arranged to cover the guide member.

20. The engine as set forth in claim 19, wherein the cover member is detachably affixed to at least one of the cylinder block and the cylinder head assembly.

21. The engine as set forth in claim 1, wherein the engine is surrounded by a protective cowling.

22. The engine as set forth in claim 1, wherein the engine powers a marine propulsion device.

23. An engine comprising an engine body defining at least one combustion chamber, an air intake passage introducing air to the combustion chamber, a valve arranged to stop air flow into the combustion chamber when placed in a stop position, a valve actuation mechanism arranged to actuate the valve from the stop position, the valve actuation mechanism including a drive unit, an actuation unit actuating the valve, and a transmitter arranged to transmit the driving force of the drive unit to the actuation unit, the transmitter being spaced apart from the engine body by a first distance, and at least one groove member arranged to support wire harness or a fluid conduit of the engine, the groove member being spaced apart from the engine body by a second distance which is different from the first distance.

24. The engine as set forth in claim 23, wherein the second distance is greater than the first distance.

25. An internal combustion engine comprising a cylinder block defining at least two cylinder bores extending generally horizontally, the cylinder bores spaced apart from each other so as to form V-configured banks, pistons reciprocating within the cylinder bores, a pair of cylinder head assemblies closing each end of the cylinder bores to define, together with the cylinder bores and the pistons, combustion chambers, an engine body being defined by at least the cylinder block and the cylinder head assembly, at least two fuel injectors, each fuel injector arranged to supply fuel at least one of the combustion chambers, the respective fuel injectors being spaced apart relative to each other, a fuel conduit communicating with the respective fuel injectors, and at least one guide member arranged to guide the fuel conduit, the guide member extending transversely over a top surface of the engine body.

26. The internal combustion engine as set forth in claim 25, wherein the guide member includes a bottom section and side sections extending generally upwardly from the bottom section so as to support the fuel conduit.

27. The internal combustion engine as set forth in claim 25 additionally comprising a cover member arranged to cover the guide member.

28. The internal combustion engine as set forth in claim 25 additionally comprising a pair of air intake passages arranged to introduce air to the combustion chambers, the respective air intake passages being disposed opposite to each other relative to the cylinder block, and the respective fuel injectors are mounted on the respective air intake passages.

29. The internal combustion engine as set forth in claim 25 additionally comprising a crankshaft extending generally vertically and coupled with the pistons so as to rotate with the reciprocal movement of the pistons, and a crankcase member closing the other end of the cylinder bores and defining a crankcase chamber together with the cylinder block in which the crankshaft rotates, wherein the engine body includes the crankcase member.

30. The engine as set forth in claim 1, wherein the wire or fluid conduit being detachably disposed on the guide member.

31. The engine as set forth in claim 1, wherein the guide member includes at least one groove guiding the wire or fluid conduit.

32. The engine as set forth in claim 31, wherein the guide member further includes an underpass formed at a portion of the groove-so as to allow part of the wire or fluid conduit to extend under the rest of the wire or fluid conduit.

33. The engine as set forth in claim 25, wherein the fuel conduit being detachably disposed on the guide member.

* * * * *